United States Patent [19]

Douty et al.

[11] 4,384,754

[45] May 24, 1983

[54] MULTI-PLANE CONNECTORS

[75] Inventors: George H. Douty, Mifflintown; Leon T. Ritchie, Mechanicsburg; Clair W. Snyder, Jr., York, all of Pa.

[73] Assignee: AMP Incorporated, Harrisburg, Pa.

[21] Appl. No.: 207,308

[22] Filed: Nov. 17, 1980

[51] Int. Cl.[3] ..... H01R 9/09; H01R 31/08

[52] U.S. Cl. ..... 339/17 M; 339/19; 339/91 R

[58] Field of Search ..... 339/17 M, 17 LM, 17 LC, 339/19, 91 R; 361/412, 413, 415

[56] References Cited

U.S. PATENT DOCUMENTS

| | | | |
|---|---|---|---|
| 3,136,591 | 6/1964 | Just et al. | 339/17 LM |
| 3,372,308 | 5/1968 | Noschese et al. | 361/393 |
| 3,404,367 | 10/1968 | Henschen | 339/217 |
| 3,492,538 | 1/1970 | Fergusson | 339/17 |
| 3,596,235 | 7/1971 | Teurlings | 339/217 R |
| 3,634,816 | 1/1972 | Zell | 339/186 M |
| 3,864,000 | 2/1975 | Coller et al. | 339/17 LC |
| 3,865,462 | 2/1975 | Cobaugh et al. | 339/176 M |
| 4,030,793 | 6/1977 | Hanlon et al. | 339/19 |
| 4,094,568 | 6/1978 | Lee et al. | 339/17 LM |
| 4,133,592 | 1/1979 | Cobaugh et al. | 339/17 M |
| 4,186,982 | 2/1980 | Cobaugh et al. | 339/17 C |

FOREIGN PATENT DOCUMENTS

| | | | |
|---|---|---|---|
| 236198 | 2/1960 | Australia | 361/413 |
| 1012747 | 12/1965 | United Kingdom . | |

OTHER PUBLICATIONS

EDN Electronic Packaging and Materials, vol. 10, No. 13, pp. 18–28, 10/65.

IBM Bulletin, Mollen et al., vol. 20, No. 11A, p. 4311, 4/78.

IBM Bulletin, Flaherty, et al., vol. 15, No. 5, p. 1533, 10/72.

*Primary Examiner*—Neil Abrams

*Attorney, Agent, or Firm*—Russell J. Egan

[57] ABSTRACT

A connector is disclosed for making a pluggable interconnection between conductive planes of adjacent pairs of stacked circuit boards. The subject connector can be used on any mating edge of a circuit board and does not require the use of either a back plane or a mother board. The subject connector can be especially effective as an add-on to original equipment but also can be used as a spacer and interconnect in new equipment. The subject connector has very cost effective stamped and formed contacts providing great economy for the connector.

21 Claims, 7 Drawing Figures

50
16
54
18a
64
74
66
42
68
62
84
52
58
18
76
70
56
82
80
72
78
20
30
24
26
28
22
14
36
38
34
12
40

MULTI-PLANE CONNECTORS

BACKGROUND OF THE INVENTION

1. The Field of the Invention

The present invention relates to a connector for providing a pluggable interconnection between conductive planes of adjacent pairs of stacked circuit boards.

2. The Prior Art

The prior art is represented by U.S. Pat. Nos. 3,404,367 and 3,634,816, both of which show a mother circuit board having a plurality of connector members attached thereto and a like plurality of daughter boards each having an edge connector and being received in a respective one of the mother board connectors. U.S. Pat. No. 4,133,592 shows a connector for electrically and mechanically joining a plurality of circuit boards in a stack. This arrangement has the clear disadvantage that the boards towards the middle of the stack are not readily accessible. Such arrangements are not readily adaptable and have the obvious disadvantage in that they must initially be designed into the system and then are rather fixed in configuration. They are generally rather expensive to install and maintain.

SUMMARY OF THE PRESENT INVENTION

The present invention pertains to a connector system which can be used to selectively connect any of the conductive planes of adjacent pairs of stacked circuit boards. The subject connector system includes a plurality of connector members each of which is secured to a mating edge of each of a like plurality of circuit boards and a plug member capable of interconnecting connector members of adjacent pairs of circuit boards. The subject connectors are fully self supporting and use inexpensive stamped and formed terminals.

It is therefore an object of the present invention to provide a connector system for interconnecting circuit boards without requiring the use of a back plane or mother circuit board.

It is another object of the present invention to provide a circuit board interconnection system which can be used as an add-on to original equipment.

It is still another object of the present invention to produce a multi-board interconnection system which can be compared to a daisey chain arrangement in that sequential edges of circuit boards are directly interconnected.

It is yet another object of the present invention to produce a multi-circuit board interconnection system which can provide interrupted bussing so that ground power and signal lines can be shifted between adjacent circuit boards as desired and necessary.

It is a further object of the present invention to produce a multi-circuit board interconnection system which allows for eady replacement of the circuit boards.

It is a further object of the present invention to produce an improved multi-board interconnection system which system acts as a spacer and/or support for the circuit boards.

It is yet another object of the present invention to produce a multi-circuit board interconnection system which can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 3 is a transverse section through a plurality of circuit boards incorporating the subject edge board connector system, one plug member being shown in a mated condition and a second exploded from the circuit boards;

DETAILED DESCRIPTION OF THE PREFERRED EMBODIMENT

Figure 1:
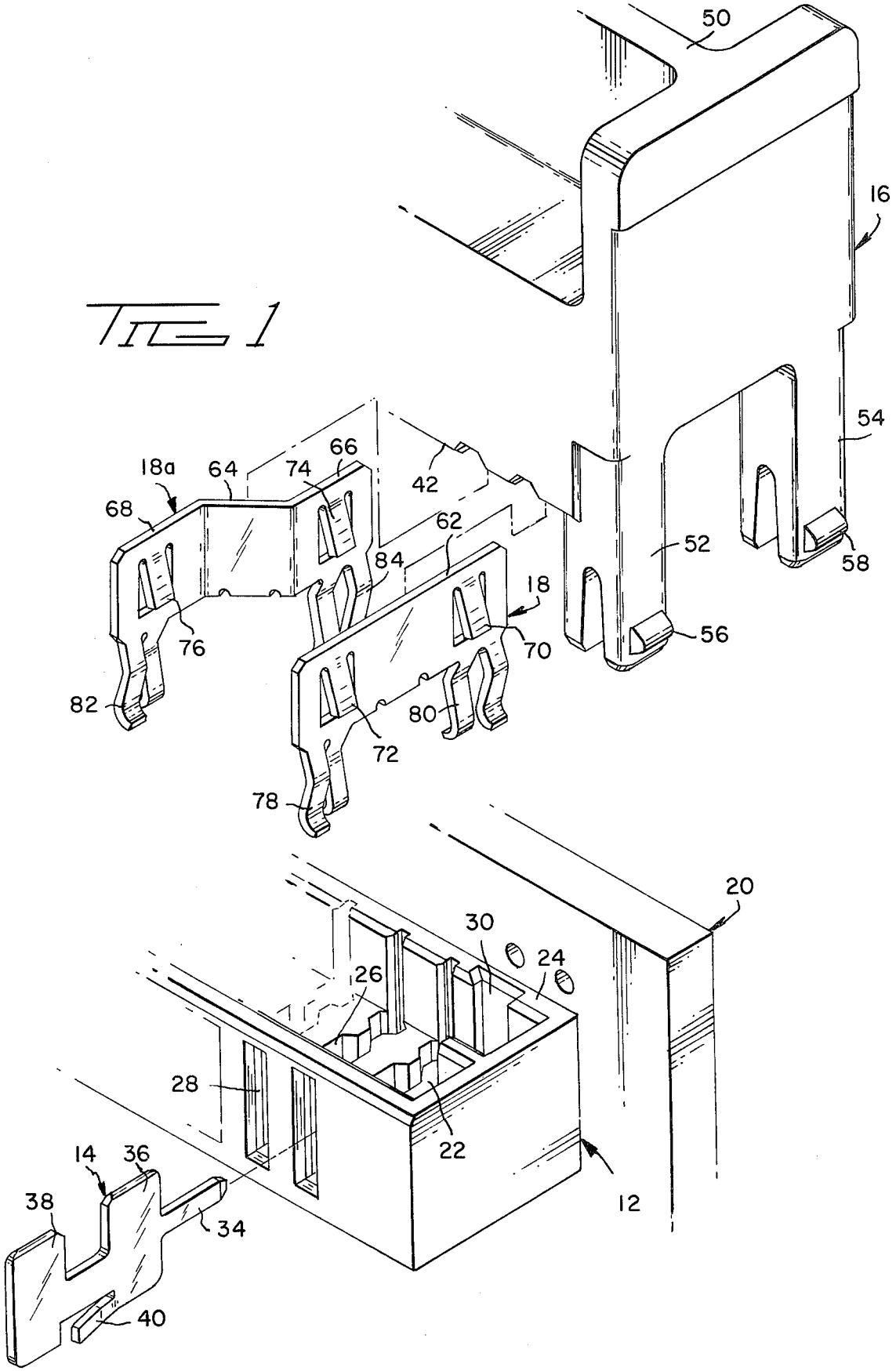
FIG. 1 is an exploded perspective view of an end portion of the edge board connector system according to the present invention.
Figure 2:
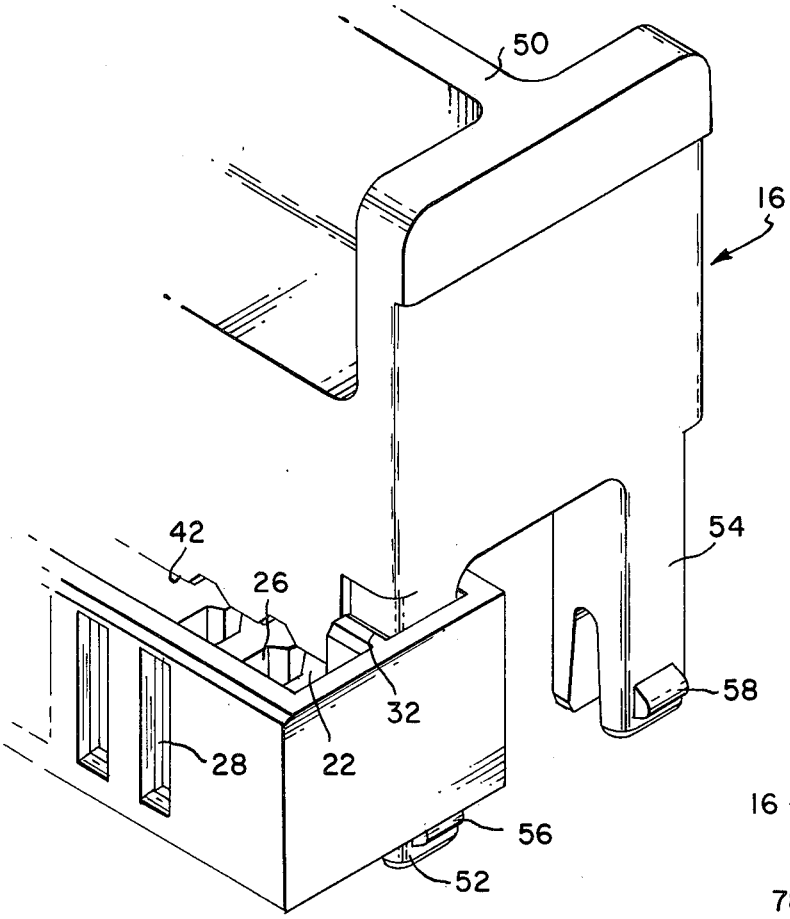
FIG. 2 is a perspective view of an end portion of the subject edge board connector system in a fully assembled condition.

Only an end fragment of the subject connector 10 is shown in the Figures. It should be recognized that the connector is generally made up of elongated rectangular plug and header members with the length of the members being determined by the number of circuits on the boards which are to be interconnected. The connector includes a header housing 12, carrying a plurality of male terminals 14, and a plug housing 16 carrying a plurality of receptacle terminals 18. The header housing 12 is mounted on an edge portion of a circuit board 20.

The header housing 12 is an elongated member of rigid insulative material defining a central cavity 22 opening onto a mating face 24. The cavity has a plurality of transverse profiled terminal recesses 26 in a base thereof with each recess being accessible from a side of the housing 12 through a respective slot 28. The housing also includes keying recesses 30 and projections 32.

The male terminal 14 is formed with a circuit board engaging pin portion 34 and a pair of parallel spaced male blades 36, 38, the axes of which extend normal to the pin portion 34. The terminal also includes a locking lance 40.

Figure 4:
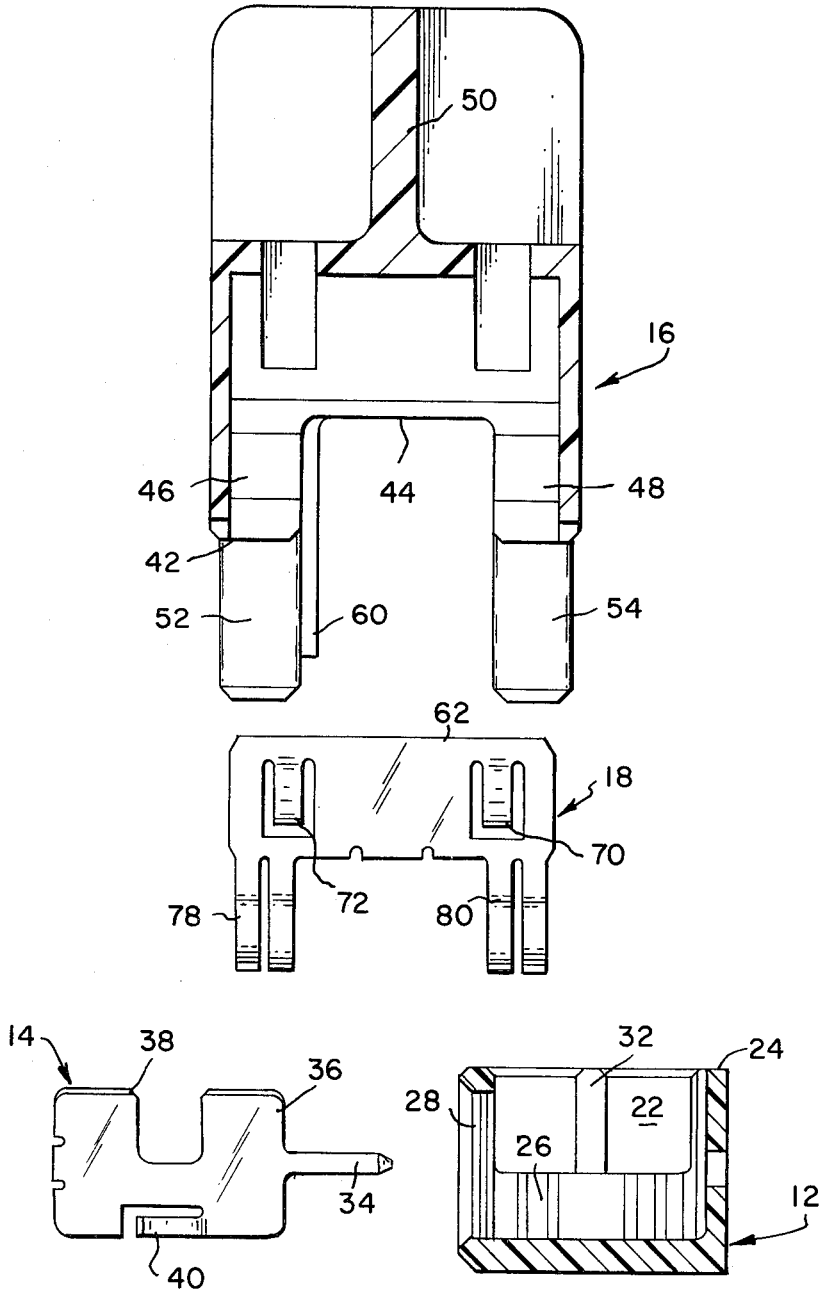
FIG. 4 is an exploded transverse section through the subject edge board connector system.

The plug housing 16 is also an elongated member of rigid insulative material having a mating face 42 with a central cavity 44 (see FIG. 3) and a plurality of terminal recesses 46, 48 extending laterally outwardly in opposite directions from the central recess 44. The plug also has a gripping handle 50 and a plurality of mounting legs 52, 54 each having a locking lug 56, 58 at the free end thereof. Leg 52 is also provided with a polarizing projection 60 (see FIG. 4).

Figure 5:
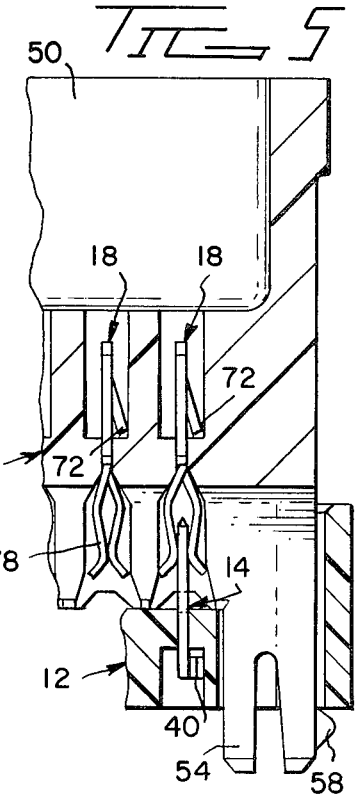
FIG. 5 is a longitudinal section through an end portion of the subject edge board connector system taken along line 5—5 of FIG. 3.
Figure 7:
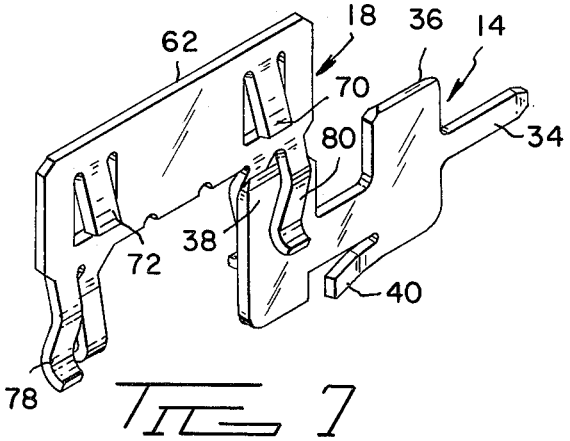
FIG. 7 is a perspective view of mated terminals according to the present invention.
Figure 6:
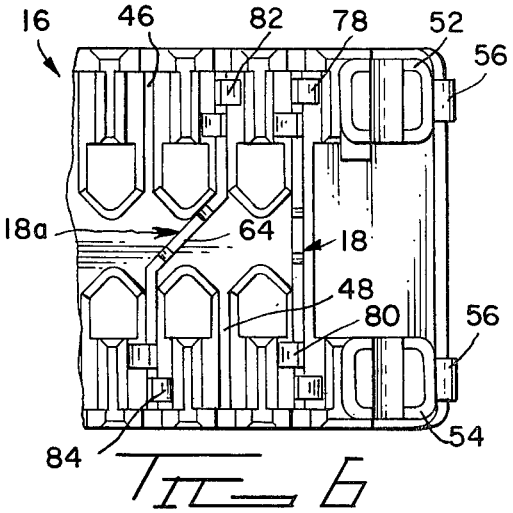
FIG. 6 is a mating end view of an end portion of a plug member of the subject edge board connector system.
Figure 7:
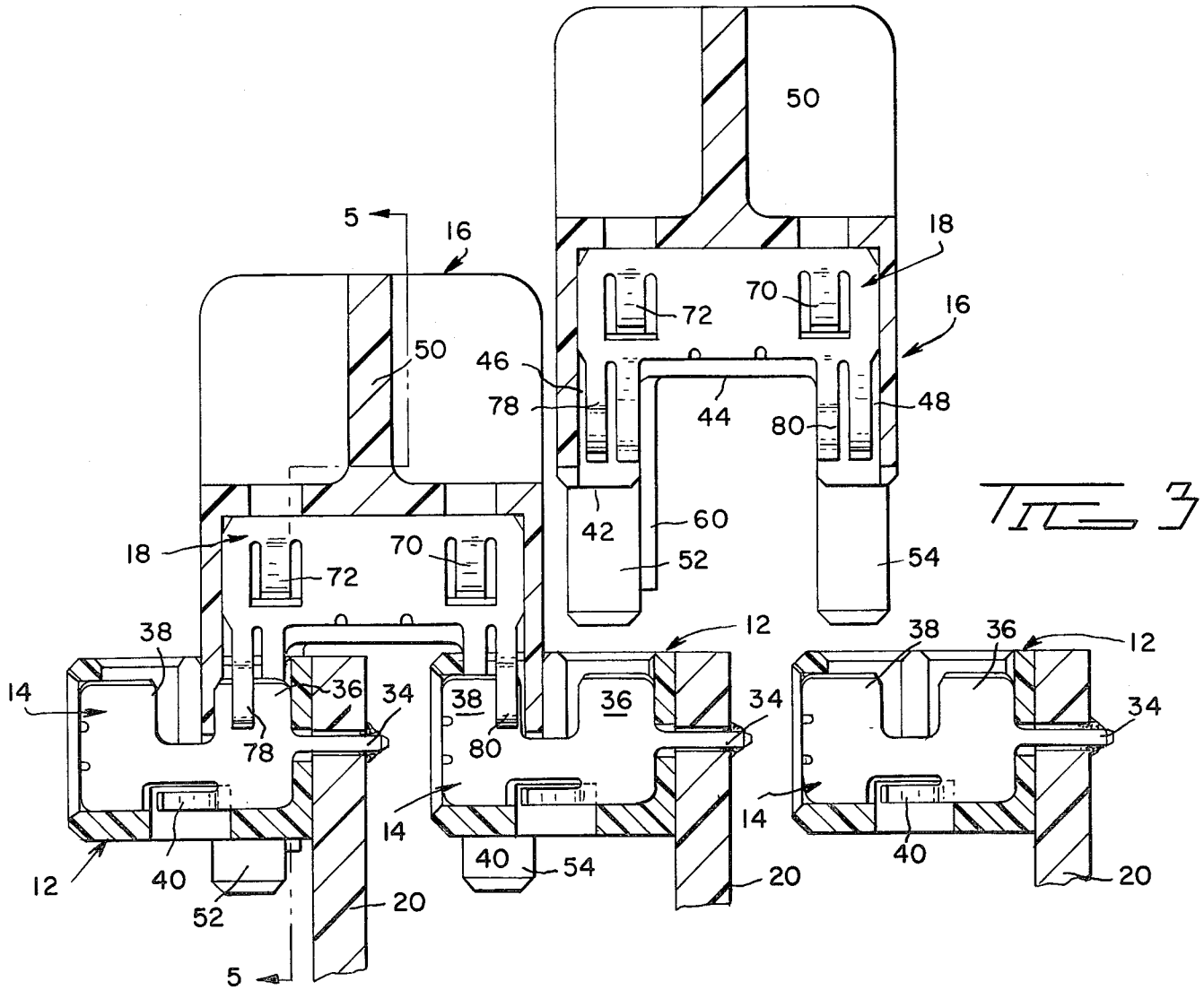

The terminal 18 is shown in FIGS. 1 and 6 in two versions. Each terminal **18, 18*a* has a central body 62, 64 with the body of the terminal 18*a* being longer than that of terminal 18 and the end portions 66, 68 are offset to lie parallel to one another. The terminals 18 and 18*a* have locking lances 70, 72, 74, 76, at the opposite ends of their bodies 62, 64 as well as pairs of depending legs 78, 80, 82, 84, each pair defining a receptacle slot therebetween (see FIGS. 5 to 7**). The pairs of legs are quite similar to those described in U.S. Pat. No. 3,865,462, the disclosure of which is incorporated herein by reference.

The operation of the subject connector system can probably best be appreciated from FIG. 3. Here it will be noted that a plurality of circuit boards 20 have each been provided with a header housing 12 with the header housings being secured to the circuit boards by means of the pin portions 34 of the terminals 14. This can be accomplished by press fit or by soldering pin portions to the boards in conventional fashion or forming the pin portions with active surfaces such as shown in U.S. Pat. No. 4,186,982, the disclosure of which is incorporated herein by reference. It should also be appreciated that if desired, the header housings 12 could be provided with legs, flanges, or other gripping means or bolt receiving means (not shown) to be secured to the circuit boards in known fashion. The circuit boards 20 are aligned in parallel spaced fashion and may be joined together in a free standing manner by application of the plug housings 16 thereto. The terminals 18 of the plug housing 16 will mate with the blade portions 36, 38 of the terminals 14 and the mounting legs 52, 54 will engage in the header housings as shown in FIGS. 3 and 5. The projection 60 on leg 52 will engage in recess 30 to assure proper polarization of the plug housing 16. The boards can thus be assembled in any fashion without the requirement for the addition of the mother board or the like.

The alternate embodiment of the receptacle terminal 18*a* shown in FIGS. 1 and 6 can be used when it is desired to effect a jumpering between circuits that are not in a direct line on adjacent circuit boards. It should be clearly understood that the intermediate body portion 64 can be of almost any length to effect a jumpering interconnection between adjacent boards, however, jumping more than one or two spaces is a highly unlikely situation.

The present invention may be subject to many modifications and changes without departing from the spirit or essential characteristics thereof. The present embodiment should therefore be considered in all respects as illustrative and not restrictive of the scope of the invention.

What is claimed is:

1. A connector system for interconnecting circuits on adjacent parallel, spaced circuit boards comprising:

a plurality of elongated header housings of rigid insulative material each mounted on an edge of respective one of a like plurality of circuit boards, a plurality of terminals fixedly mounted in each said header housing, each said terminal having a first and second mating portions and a third portion attached to circuitry of the respective circuit board, and a plurality of elongated plug housings of rigid insulative material each having a plurality of double ended receptacle terminals mounted therein, each said plug housing being adapted to insert into one half, of a first header housing and one half of an adjacent second header housing with each said double ended receptacle terminal mating with a respective mating portion of a terminal in each said first and second header housing said terminals of said header and plug housings being so formed that said first mating portion of each header terminal can receive one of the receptacle terminals of one of said plug housings while the second mating portion of each header terminal can simultaneously receive one of the receptacle terminals of a different plug housing whereby at least three adjacent circuit boards can be selectively interconnected.

2. A connector system according to claim 1 wherein each said header housing further comprises:

polarizing means.

3. A connector system according to claim 1 wherein each said header housing further comprises:

a pair of parallel spaced elongated openings each adapted to receive therein one half of a mating plug housing.

4. A connector system according to claim 3 wherein each header housing terminal comprises:

a unitary conductive member having a pair of parallel mating blades forming said first and second mating portions each lying in a respective header housing opening and adapted to matingly engage an end of a respective receptacle terminal, and a pin portion electrically contacting circuitry of said respective circuit board.

5. A connector system according to claim 1 further comprising:

means to secure each said header housing to its respective circuit board.

6. A connector system according to claim 1 wherein each said terminal in each said header housing comprises:

a stamped and formed unitary member of conductive material having first and second parallel spaced mating blade portions, a circuit engaging pin portion extending normal to and in the plane of said blade portions, and at least one laterally directed locking lance.

7. A connector system according to claim 1 wherein each said plug housing further comprises a handle facilitating the movement thereof.

8. A connector system according to claim 1 wherein each said plug housing further comprises:

a plurality of depending legs matable with respective pairs of header housings.

9. A connector system according to claim 8 wherein said legs further comprise:

polarizing means.

10. A connector system according to claim 8 wherein said legs further comprise:

latching means.

11. A connector system according to claim 1 wherein each said double ended receptacle terminal comprises:

an elongated body of conductive material having pairs of legs depending from opposite ends thereof, said legs being offset to define a blade receiving slot and being bent to resiliently engage a blade inserted into said slot.

12. A connector system according to claim 11 wherein each said double ended receptacle further comprises:

locking lance means securing said receptacle terminal in said plug housing.

13. A connector system according to claim 11 wherein each end of said double ended receptacle are laterally offset to lie in parallel spaced planes whereby the receptacle terminal can provide interrupted bussing between adjacent circuit boards.

14. A system for selectively interconnecting pairs of a plurality of parallel spaced circuit boards comprising:

a header housing mounted on an edge portion of each said circuit board, each said header housing being an elongated member of rigid insulative material having a central passage, a plurality of male terminals located in said passage, each said male terminal having first and second blade portions extending normal to a pin portion, said pin portion being electrically and mechanically attached to the circuitry of the respective circuit board; and a plug housing for every pair of circuit boards, each said plug housing being an elongated member of rigid insulative material having a plurality of receptacle terminals secured therein, said receptacle terminals having receptacle portions in parallel spaced relation depending from opposite ends of a central body by a distance defined by the spacing between adjacent circuit boards, each said receptacle portion receiving a respective blade portion therein, and insulative mounting legs on said plug housing adapted to be grippingly received in said header housings whereby adjacent printed circuit boards can be selectively interconnected said terminals of said header and plug housings being so formed that said first blade portions of each header terminal can receive one of the receptacle portions of one of said receptacle terminals of one of said plug housings while the second blade portion of each header terminal can simultaneously receive one of the receptacle portions of one of said receptacle terminals of a different plug housing whereby a central circuit board can be selectively interconnected with circuit boards to each side of it.

15. A system according to claim 14 further comprising:

polarizing means on said header housings and said plug housings.

16. A system according to claim 14 further comprising:

latching means on said mounting legs and said header housings for securing said plug housings therein.

17. A system according to claim 14 wherein each said header housing central passage further comprises:

a pair of parallel spaced elongated recesses each receiving therein one half of a mating plug housing, said terminals being located with a blade portion lying in each said elongated recess.

18. A system according to claim 14 wherein each said terminal in said header housing further comprises:

a locking lance.

19. A system according to claim 14 wherein each said plug housing further comprises:

a handle facilitating the movement thereof.

20. A system according to claim 14 wherein each said receptacle portion of each said receptacle terminal comprises:

a pair of legs offset to define a slot therebetween, said legs being bent to resiliently engage a blade portion received in said slot.

21. A system according to claim 14 wherein each end of each said receptacle terminal is laterally offset so that the respective receptacle portions lie in parallel spaced planes whereby interrupted bussing can be provided between adjacent circuit boards.

* * * * *